US005813903A

United States Patent [19]

Amano et al.

[11] Patent Number: 5,813,903

[45] Date of Patent: Sep. 29, 1998

[54] SANDING APPARATUS WITH A BRAKE SYSTEM

[76] Inventors: Kunio Amano; Katsuhiko Sasaki; Tetsuhisa Kaneko; Masatoshi Kobayashi; Koji Takeuchi, all of c/o Makita Corporation 11-8 Sumiyoshi-cho 3-chome, Anjo-shi, Aichi-ken, Japan

[21] Appl. No.: 813,658

[22] Filed: Mar. 7, 1997

[30] Foreign Application Priority Data

Mar. 8, 1996 [JP] Japan ..... 8-052036
Dec. 6, 1996 [JP] Japan ..... 8-327201

[51] Int. Cl.[6] ..... B24B 23/03

[52] U.S. Cl. ..... 451/294; 451/357

[58] Field of Search ..... 451/294, 357, 451/359, 344

[56] References Cited

U.S. PATENT DOCUMENTS

| | | | |
|---|---|---|---|
| 5,018,314 | 5/1991 | Fushiya et al. | 451/357 |
| 5,317,838 | 6/1994 | Bourner | 451/294 |
| 5,384,984 | 1/1995 | Smith | 451/357 |
| 5,392,568 | 2/1995 | Howard, Jr. et al. | 451/357 |

FOREIGN PATENT DOCUMENTS

| | | | |
|---|---|---|---|
| 0254850A2 | 6/1987 | European Pat. Off. | B24B 55/00 |
| 0320599A1 | 10/1988 | European Pat. Off. | B24B 23/03 |
| 0559020A1 | 2/1993 | European Pat. Off. | B24B 23/03 |
| 0713751A1 | 5/1996 | European Pat. Off. | B24B 23/03 |

*Primary Examiner*—Robert A. Rose
*Attorney, Agent, or Firm*—Lahive & Cockfield, LLP

[57] ABSTRACT

A sander (1) has a motor (3) with a motor shaft (4) mounted in a bearing box (11) via an eccentric ball bearing (10). Coupled to the bearing box (11) is a pad (12) having a bulged square shape in a horizontal cross section. The sander (1) further includes a skirt (6) with an opening (6*a*) on which a synthetic (polyurethane rubber) brake ring (17) is mounted. The brake ring (17) comprises an outer peripheral portion (18) and a plurality of contact portions (19) disposed at regular intervals around the outer peripheral portion (18). Each contact portion (19) is bulged toward the center of the brake ring (17) with both ends connected to the outer peripheral portion (18). Also, the contact portions (19) are elastic so as to deform in the radial direction. The contact portions (19) together form a through-hole (21) which is slightly smaller than the bearing box (11) for receiving the bearing box.

19 Claims, 6 Drawing Sheets

SANDING APPARATUS WITH A BRAKE SYSTEM

BACKGROUND OF THE INVENTION

1. Field of the Invention

The present invention relates to a sander. More particularly, the present invention relates to a sander with a brake system and a pad for mounting an abrasive sheet, such as sand-paper, which performs a predetermined movement such as an orbital motion in order to sand a workpiece.

2. Description of the Prior Art

FIG. 8 illustrates a random orbit sander 30 as disclosed in U.S. Pat. No. 5,018,314. Reference numeral 31 designates a body or housing 31 which encases a motor 32 having a rotary shaft 33. An eccentric shaft 34 is integrally formed with the lower end of the rotary shaft 33. The eccentric shaft 34 is supported by a ball bearing 35. A bearing box 36 is eccentrically mounted on the ball bearing 35. Screwed to the bottom surface of the bearing box 36 is a pad 37 mounting a sand-paper 38 on the bottom surface thereof. When rotated, the motor 32 imparts the random orbital movement (orbital movement+rotational movement) to the pad 37 due to the eccentric shaft 34 and the bearing box 36 so as to sand a workpiece.

In certain random orbit sanders, when the motor is turned on, the pad quickly reaches a high rotational speed. Therefore, the operator must be extremely careful not to damage the surface of the workpiece when the sander is brought into contact with the workpiece. Moreover, when the sander is switched off, the pad does not immediately stop rotating due to the inertia force thereof, so that the operator is obliged to hold up the sander until the pad stops, thereby causing loss of time.

In the random orbit sander 30 of FIG. 8, a leaf spring 39 is provided on the bottom edge of the body 31 for making intermittent contact with, and thereby applying friction to, the pad 37 while the pad is performing the random orbit movement. The friction between the leaf spring 39 and the pad 37 checks or restrains the rotation of the pad 37 as soon as the motor 32 is switched on. The friction also helps to stop the pad 37 quickly after the motor 32 is switched off.

The aforementioned brake system, however, leaves some room for improvement in its reliability. For instance this brake system cannot effectively check the rotation of the pad 37 since the leaf spring 39 applies friction to the pad 37 only intermittently. Furthermore, this brake system suffers from the disadvantage that the braking ability decreases over time as the leaf spring 39 loses its elasticity. In addition, the pad 37, by repeatedly coming to contact with the leaf spring 39, tends to become damaged over time.

SUMMARY OF THE INVENTION

In view of the above-identified problems, it is an object of the present invention to provide a highly reliable, simply structured brake system.

It is another object of the present invention to provide a simply structured brake system that does not damage the pad.

It is yet another object of the present invention to provide a simply structured, durable brake system.

The above objects and other related objects are realized by providing a sanding apparatus which comprises a housing having an opening at a lower end thereof and a motor provided in the housing. The motor has a motor shaft protruding from the opening of the housing. The sanding apparatus further comprises a connecting shaft including an eccentric movement mechanism. The connecting shaft is coupled to the motor shaft via the eccentric movement mechanism. The sanding apparatus further comprises a pad coupled to the connecting shaft for performing a predetermined movement in response to rotation of the motor and brake means provided at the opening of the housing. The brake means is penetrated by the connecting shaft and includes at least one contact portion which is in contact with the connecting shaft so as to restrain the movement of the connecting shaft and which allows movement of the connecting shaft at normal operating speed when the pressure applied from the pad to the connecting shaft exceeds a predetermined value.

According to one aspect of the present invention, the brake means further includes an outer peripheral portion mounted at the opening of the housing. The at least one contact portion has an annular shape surrounding the periphery of the connecting shaft. The brake means further includes a plurality of connecting members which elastically hold the at least one contact portion.

In carrying out the invention in one preferred mode, the connecting shaft has a substantially circular external shape and each of the connecting members has an approximate S-shape with a first end thereof connected to the outer peripheral portion and a second end thereof connected to the at least one contact portion such that, when the connecting shaft is rotated, the connecting members are permitted to deform slightly.

According to another aspect of the present invention, the connecting shaft has any external shape except a complete circle and the at lest one contact portion has such a shape as to permit the connecting shaft to fit therein.

According to still another aspect of the present invention, the brake means further includes an outer peripheral portion mounted at the opening of the housing. The at least one contact portion comprises a plurality of elastic members each having two ends. Each of the elastic members is connected to the outer peripheral portion at the two ends so that the elastic members bulge inwardly toward the center of the outer peripheral portion and define an opening which is penetrated by the connecting member.

According to yet another aspect of the present invention, the connecting shaft has a substantially square cross section perpendicular to the axis thereof.

Preferably, the connecting shaft has a circular cross section perpendicular to the axis thereof.

In another preferred mode of the present invention, the connecting shaft has a circular shape with a plurality of angular protrusions in cross section perpendicular to the axis of the connecting shaft.

BRIEF DESCRIPTION OF THE DRAWINGS

For a fuller understanding of the nature and objects of the present invention, reference should be made to the following detailed description and the accompanying drawings, in which.

DETAILED DESCRIPTION OF THE PREFERRED EMBODIMENTS

A preferred embodiment of the present invention will be explained hereinafter with specific reference to the attached drawings.

Figure 1:
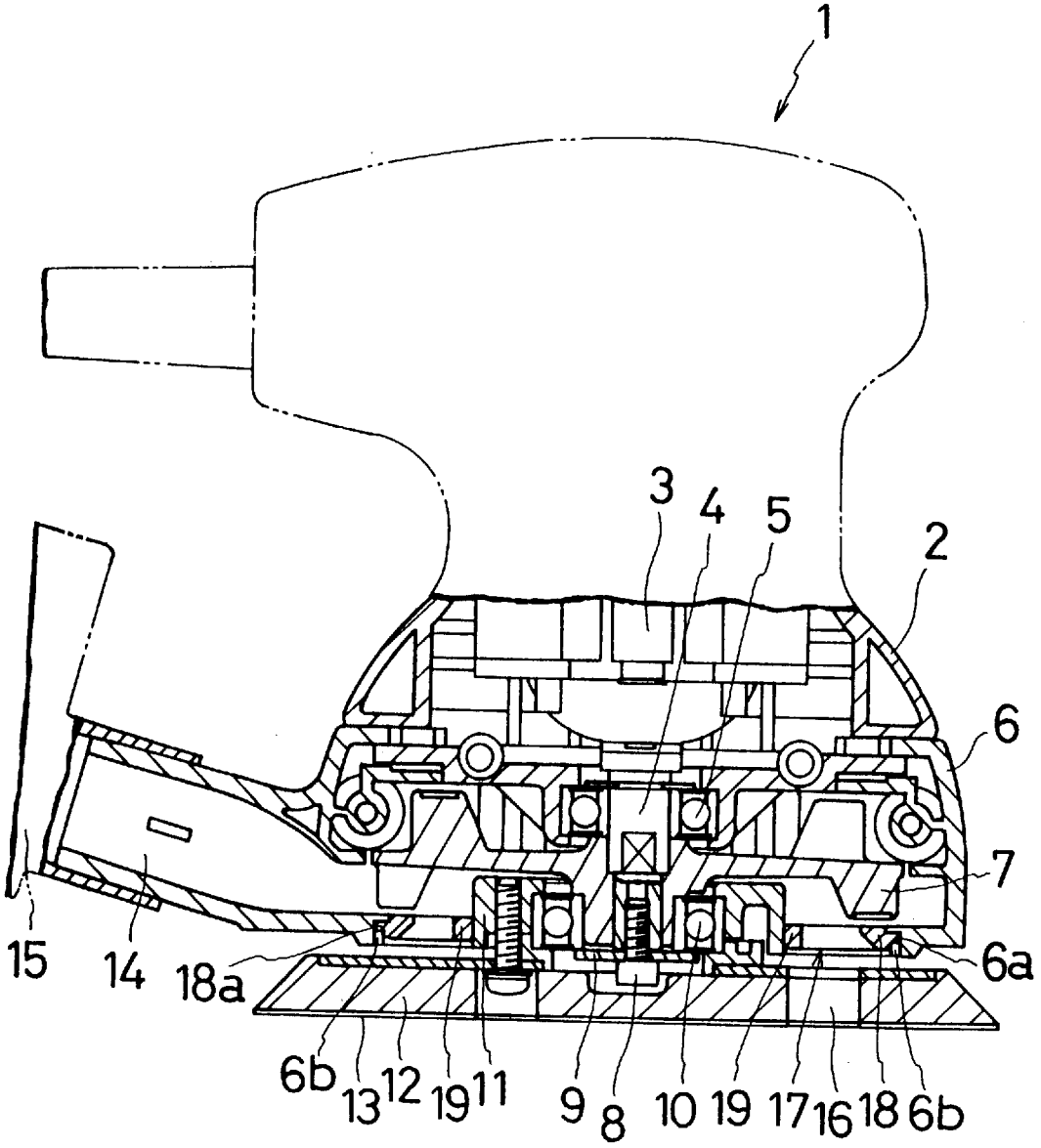
FIG. 1 is a partial cross sectional view of a random orbit sander embodying the present invention.

Referring to FIG. 1, reference numeral 1 generally designates a random orbit sander which includes a split housing 2 composed of right and left halves. The split housing 2 accommodates a motor 3 with a motor shaft 4 which is supported by a ball bearing 5. The motor shaft 4 protrudes into a split skirt 6 composed of right and left halves which are attached to the bottom of the housing 2. A fan 7 is secured to the lower end of the motor shaft 4 with a bolt 8 and a washer 9. Mounted on the fan 7 is another ball bearing 10 disposed eccentrically to the axis of the motor shaft 4. An eccentric bearing box 11 which serves as a connecting shaft is mounted on the ball bearing 10. Screwed on the bearing box 11 is a pad 12 which mounts a sand-paper 13 on the bottom surface thereof. As shown in FIGS. 3, 4A, 4B, and 4C, the bearing box 11 has an approximate square shape in a horizontal (i.e., orthogonal to the axial direction) cross section with four convex sides and corners 11*a*

When the motor 3 is rotated, the rotation is transmitted to the bearing box 11 via the ball bearing 10, which is disposed eccentrically to the motor shaft 4. Thus, the bearing box 11 and the pad 12 perform a random orbital movement (orbital movement+rotational movement).

Referring again to FIG. 1, reference numeral 14 designates a dust nozzle projected from the skirt 6. A dust bag 15 is attached to one end of the dust nozzle 14. A through-hole 16 is formed in the pad 12 and the sand-paper 13 and the through-hole 16 is connected to an opening 6*a* formed in the bottom of the skirt 6. With this construction, dust generated during sanding is sucked by the rotation of the fan 7 through the through-hole 16 and the opening 6*a* into the skirt 6. Subsequently, the dust is drawn into the dust bag 15 through the nozzle 14.

Figure 2:
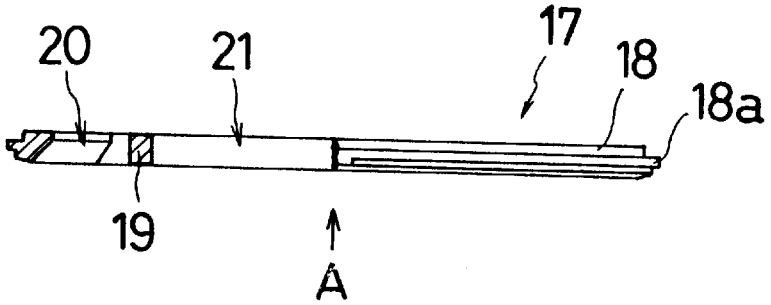
FIG. 2 illustrates the brake ring of FIG. 1 with the left half shown in cross section.
Figure 3:
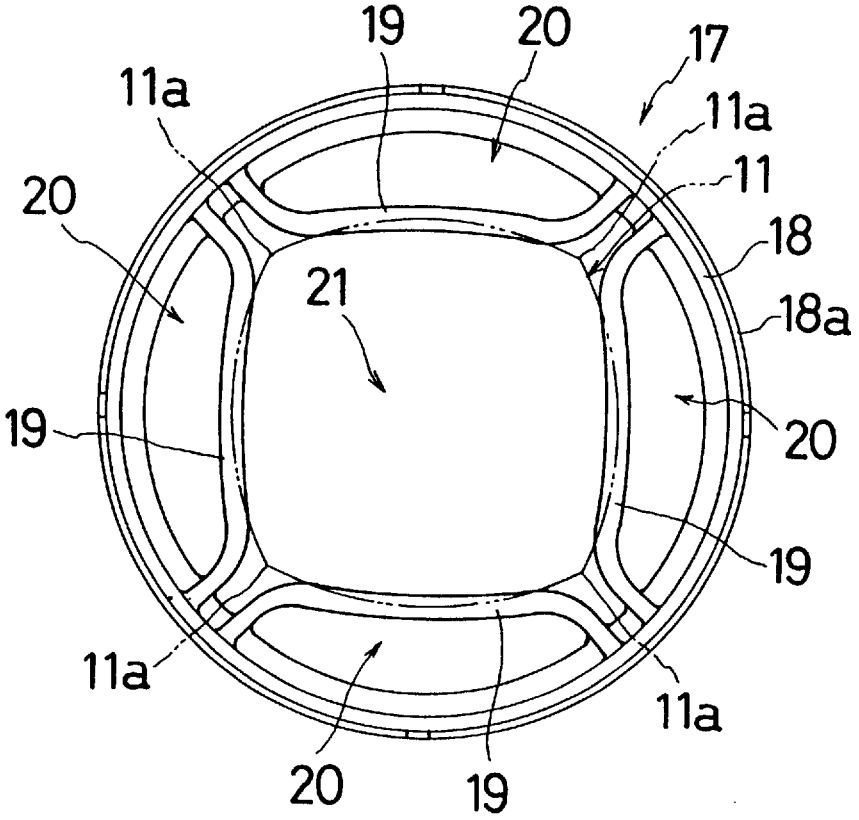
FIG. 3 is a bottom view of the brake ring of FIG. 2 seen from the direction indicated by arrow A.

Referring now to FIGS. 1–3, a brake ring 17 made of synthetic resin (polyurethane rubber) is provided on the opening 6*a* of the skirt 6. The brake ring 17 comprises an annular outer peripheral portion 18 and four identical contact portions 19 formed within the outer peripheral portion 18 on its circumference at regular intervals. Also, the outer peripheral portion 18 has an engaging flange 18*a* formed around its circumference. When the right and left halves of the skirt 6 are fitted together around the braking ring 17, the flange 18*a* engages a plurality of protrusions 6*b* formed on the opening 6*a*, thus securely fitting in the skirt 6. Each contact portion 19 bulges toward the center of the brake ring 17 with both ends connected to the outer peripheral portion 18. The contact portions 19 define dust intake ports 20 between themselves and outer peripheral portion 18, and also form a through-hole 21 which is slightly smaller than the cross section of the bearing box 11. It should be noted that the contact portions 19, being made of elastic material, are capable of warping in the radial direction, so that the bearing box 11 can be fit in the through-hole 21.

Figure 4A:
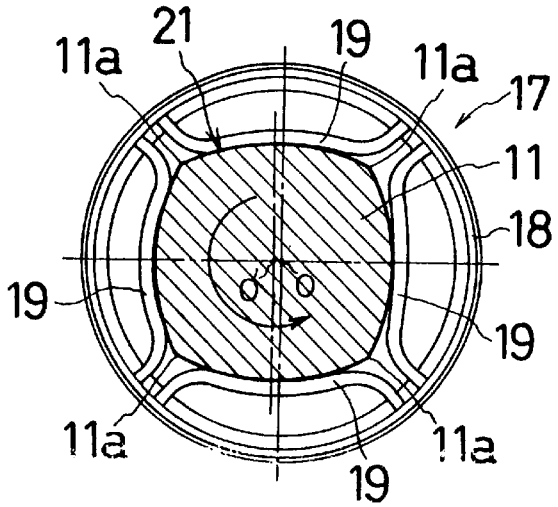
FIGS. 4A–4C illustrate the function of the brake ring of FIG. 1.

As shown in FIG. 4A, when the motor is not driven, the bearing box 11 (the internal structure is omitted from the drawing for clarity) fits in the through-hole 21, being elastically held by the four contact portions 19 at its sides. At the same time, each of the corners 11*a* fits between a pair of adjacent contact portions 19. Center O' of the bearing box 11 is located eccentrically with respect to center O of the brake ring 17.

Figure 4B:
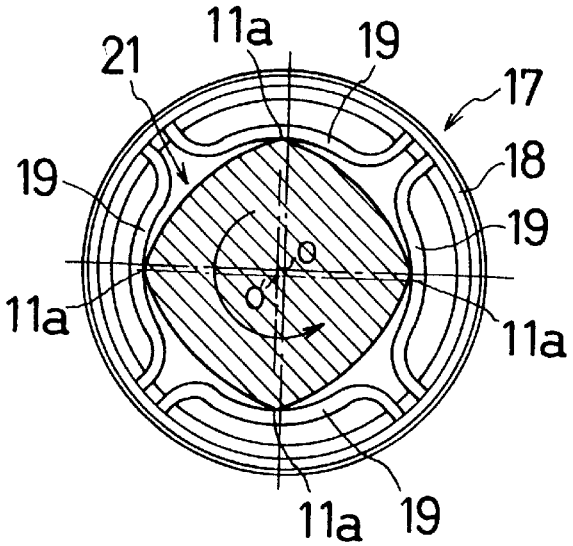

When the motor 3 is rotated, the bearing box 11 starts a counterclockwise random orbital movement, causing the corners 11*a* to move away from between the contact portions and to radially deform the contact portions 19 again (see FIG. 4B) until fitting between the next pairs of contact portions 19 (see FIG. 4C) upon completion of a 90 degree rotation. Therefore, for each 90 degree rotation of the bearing box 11, the elastic contact portions 19 apply a resistance force on the periphery of the bearing box 11 to maintain the box in the position as shown in FIG. 4A and then the friction between the corners 11*a* and the contact portions 19 also applies a resistance force on the bearing box 11 as shown in FIG. 4B. This resistance checks the rotation of the bearing box 11 and thus the pad 12 until after the pad 12 is applied to the workpiece. The bearing box 11 continuously rotates at a higher, normal operating speed only after the pad 12 is applied to the workpiece and the force pressing the pad 12 exceeds the force applied to the bearing box 11 by the contact portions 19.

Figure 4C:
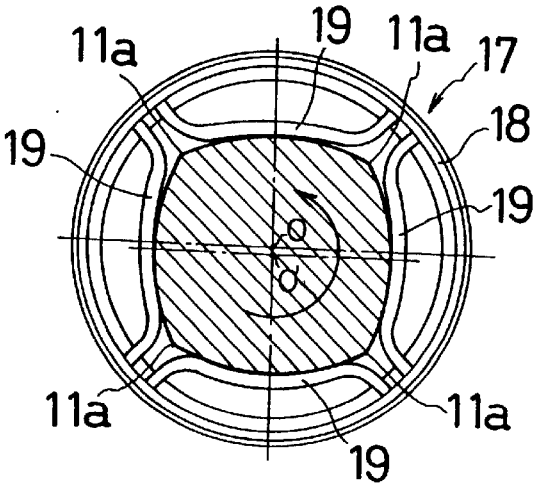

Once the motor 3 is turned off, the surface resistance of the elastic contact portions 19 and the edge resistance of the corners 11*a* that occur as the bearing box 11 rotates from the position of FIG. 4A to that of FIG. 4B effectively slows down the rotation of the bearing box 11 due to its inertia force. Eventually, the bearing box 11 stops in the position as shown in FIGS. 4A and 4C with the corners 11*a* fitted between the contact portions 19. In this way, the pad 12 can be stopped promptly once the motor 3 is turned off. Likewise, when the pad 12 is lifted off of the workpiece surface, the contact portions 19 effectively restrain the rotation of the bearing box 11.

As explained above, the brake system of the embodiment can check or restrain the rotational speed of the pad 12 following the start of the motor 3 and quickly stops the rotation of the pad once the motor is turned off or the sanding is suspended by lifting the sander 1 off of the workpiece surface. This prevents the sander from damaging the workpiece surface due to the extremely high speed rotation of the pad 12 and improves the work efficiency by reducing loss of time when sanding is either suspended or finished. Furthermore, this structure is quite durable and reliable and can be used without the fear of damaging the pad 12, unlike the conventional braking system.

The horizontal cross sectional shape of the bearing box does not have to be an approximate square as in this embodiment; it may have a triangular or some other polygonal shape. Alternatively, the cross section of the bearing box may be completely circular as will be explained below in connection with FIG. 6. Accordingly, the design (such as the shape and/or the number) of the contact portions 19 of the brake ring 17 may be changed to match the adopted shape of the bearing box 11. For instance, the connecting shaft may have a circular cross section with recesses formed on its periphery while the contact portions are provided with projections for engaging the recesses. It should be noted that the skirt may be integrally formed with the housing, instead of being separately provided as in the embodiment.

Figure 5:
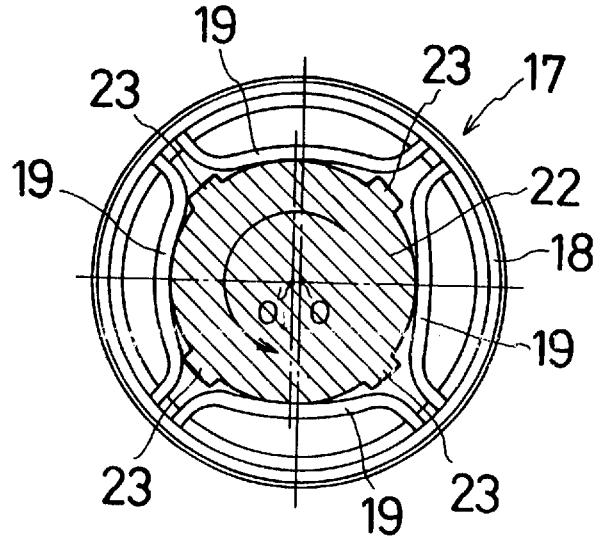
FIG. 5 is a bottom view of a modified bearing box with square protrusions in accordance with the present invention.
Figure 6:
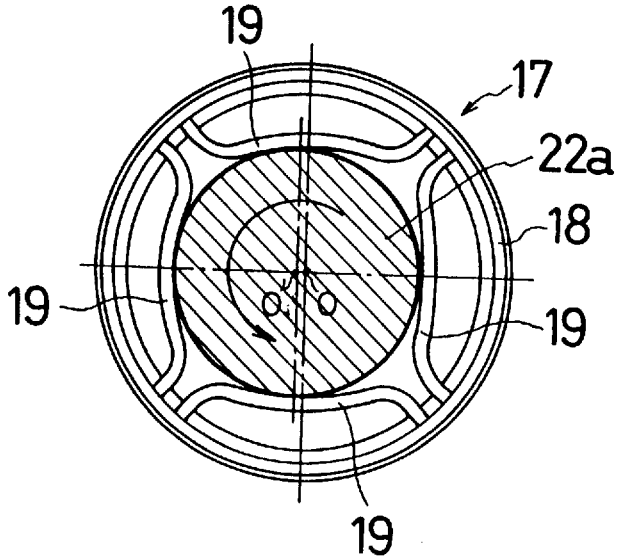
FIG. 6 is a bottom view of a modified, circular bearing box in accordance with the present invention.

FIG. 5 shows a modified bearing box 22 having a circular cross section with four angular protrusions formed around its periphery. This modification makes use of the edge resistance of the protrusions to the contact portions only, rather than the edge and surface resistance as in the above-described embodiment. FIG. 6 shows a bearing box 22*a* with a circular cross section without any protrusions which is used in combination with the contact portions 19. Even in this case the rotation of the bearing box 22*a* can be kept in check by the surface resistance of the contact portions 19 on the bearing box 22*a*.

Figure 7A:
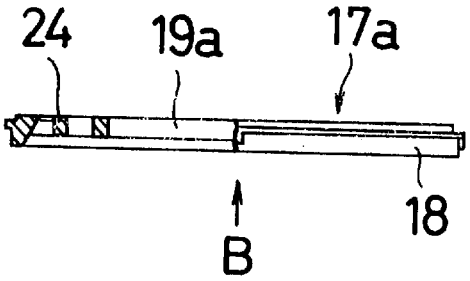
FIG. 7A illustrates the brake ring in accordance with the present invention with the left half shown in cross section.
Figure 7B:
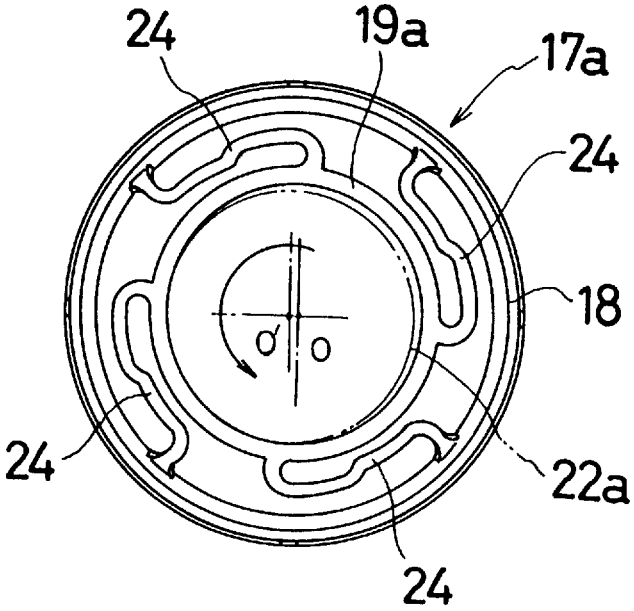
FIG. 7B is a bottom view of the brake ring of FIG. 7A seen from the direction indicated by arrow B.
Figure 8:
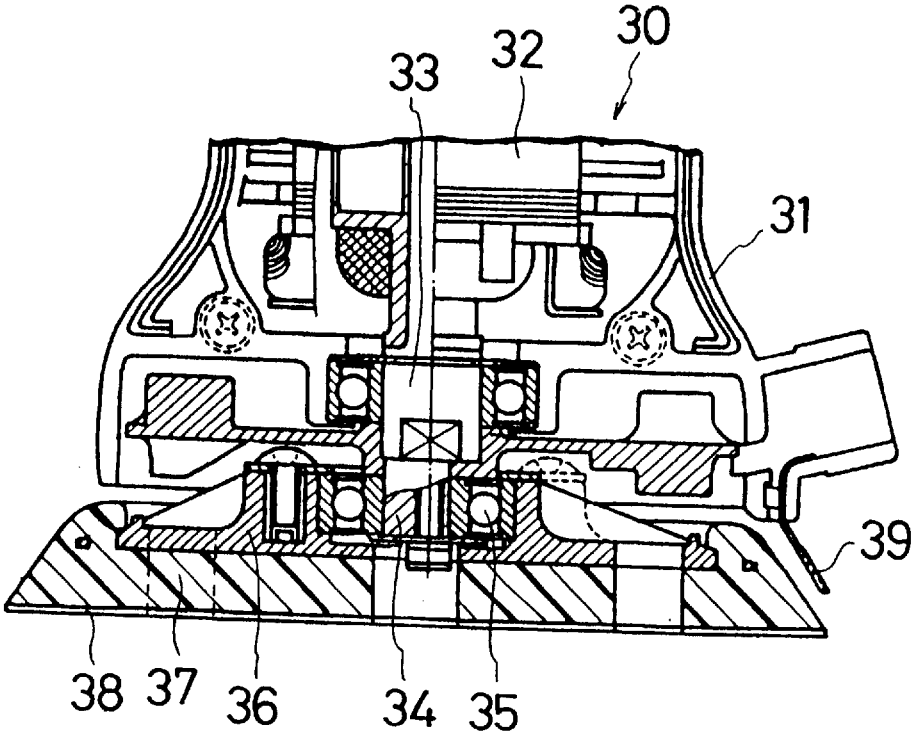
PRIOR ART Fig 8
FIG. 8 is a cross sectional view of the lower half of a conventional random orbit sander.

If the contact portions are separate members as in the foregoing embodiment and modifications, they come into intermittent contact with the bearing box, thereby causing unpleasant noise in some cases. The structure shown in FIGS. 7A and 7B can provide a solution to this problem. FIG. 7A is a partial cross sectional view of a modified brake ring 17*a* while FIG. 7B is a bottom view of the brake ring 17*a* seen from the direction indicted by arrow B. Reference numeral 19*a* is an annular contact portion with a diameter slightly larger than that of the bearing box 22*a*. The contact portion 19*a* is connected to the outer peripheral portion 18 by four equally spaced elastic connecting members 24. In this way, the contact portion 19*a* is always in contact with a portion of the bearing box 22*a*. As illustrated in the drawing, each connecting member 24 has an approximate S-shape extending in the peripheral direction with one end of the S connected to the outer peripheral portion 18 and the other connected to the contact portion 19*a*. During operation, the surface resistance of the contact portion 19*a* holds the rotation of the bearing box 22*a* in check when the motor is turned on, while the resistant force functions as a quick and effective brake when sanding is stopped or suspended. Moreover, as the contact portion 19*a* rotates while remaining in contact with a portion of the bearing box 22*a* at all times, the above-described unpleasant noise does not occur.

Except in the structure described in connection with FIG. 7, the rotational force of the bearing box is transmitted to and deforms the outer peripheral portion 18, causing vibration and noise in some cases. In the brake ring 17*a* as shown in FIG. 7, however, the elastic connecting members 24 deforms in response to the rotational force applied thereto by the bearing box so as to permit slight rotation of the contact portion 19*a*. Therefore, the rotational force is not transmitted to the outer peripheral portion 18, effectively preventing vibration and noise of the outer peripheral portion. The number and/or shape of connecting members 24 is subject to change according to the particular application as long as rotation of the contact portion 19*a* is ensured in the above-described manner.

As there may be many other modifications, alterations, and changes without departing from the scope or spirit of the essential characteristics of the present invention, it is to be understood that the above embodiment is only an illustration and not restrictive in any sense. The scope or spirit of the present invention is limited only by the terms of the appended claims.

What is claimed is:

1. A sanding apparatus comprising:

a housing having an opening at a lower end thereof;

a motor provided in said housing, said motor having a motor shaft protruding from said opening of said housing;

a connecting shaft including an eccentric movement mechanism, said connecting shaft being coupled to said motor shaft by said eccentric movement mechanism;

a pad coupled to said connecting shaft for performing a predetermined movement in response to rotation of said motor; and brake means, penetrated by said connecting shaft, provided at said opening of said housing, said brake means being symmetrically disposed about said connecting shaft and including at least one contact portion which is in contact with said connecting shaft so as to restrain the movement of said connecting shaft and which allows movement of said connecting shaft at normal operating speed when the pressure applied from said pad to said connecting shaft exceeds a predetermined value.

2. The sanding apparatus in accordance with claim 1 wherein said brake means further includes an outer peripheral portion mounted at said opening of said housing, said at least one contact portion has an annular shape surrounding the periphery of said connecting shaft, and said brake means further includes a plurality of connecting members which elastically hold said at least one contact portion.

3. The sanding apparatus in accordance with claim 2 wherein said connecting shaft has a substantially circular external shape and wherein each of said connecting members has an approximate S-shape with a first end thereof connected to said outer peripheral portion and a second end thereof connected to said at least one contact portion such that, when said connecting shaft is rotated, said connecting members are permitted to deform slightly.

4. The sanding apparatus in accordance with claim 2 wherein said connecting shaft has a non-circular cross section and said at least one contact portion is shaped to permit said connecting shaft to fit therein.

5. The sanding apparatus in accordance with claim 1 wherein said brake means further includes an outer peripheral portion mounted at said opening of said housing and wherein said at least one contact portion comprises a plurality of elastic members each having two ends, each of said elastic members being connected to said outer peripheral portion at said two ends so that said elastic members bulge inwardly toward the center of said outer peripheral portion and define an opening which is penetrated by said connecting member.

6. The sanding apparatus in accordance with claim 5 wherein said connecting shaft has a substantially square cross section perpendicular to the axis thereof.

7. The sanding apparatus in accordance with claim 5 wherein said connecting shaft has a circular cross section perpendicular to the axis thereof.

8. The sanding apparatus in accordance with claim 5 wherein said connecting shaft has a circular shape with a plurality of angular protrusions in cross section perpendicular to the axis of said connecting shaft.

9. The sanding apparatus in accordance with claim 7 wherein said connecting shaft includes a plurality of radial protrusions coplanar with a plane perpendicular to the axis of said connecting shaft.

10. The sanding apparatus in accordance with claim 1 wherein said connecting shaft has a non-circular cross-section and said at least one contact portion is shaped to permit said connecting shaft to fit therein.

11. A sanding apparatus comprising:

a housing having an opening at a lower end thereof;

a motor provided in said housing, said motor having a motor shaft protruding from said opening of said housing;

a connecting shaft including an eccentric movement mechanism, said connecting shaft being coupled to said motor shaft via said eccentric movement mechanism;

a pad coupled to said connecting shaft for performing a predetermined movement in response to rotation of said motor; and brake means provided at said opening of said housing, said brake means being penetrated by said connecting shaft and including at least one contact portion which is in contact with said connecting shaft so as to restrain the movement of said connecting shaft and which allows movement of said connecting shaft at normal operating speed when the pressure applied from said pad to said connecting shaft exceeds a predetermined value, said brake means further including an outer peripheral portion mounted at said opening of said housing, said at least one contact portion has an annular shape surrounding the periphery of said connecting shaft, and said brake means further includes a plurality of connecting members which elastically hold said at least one contact portion.

12. The sanding apparatus with claim 11 wherein said connecting shaft has a non-circular cross-section and said at least one contact portion is shaped to permit said connecting shaft to fit therein.

13. The sanding apparatus in accordance with claim 11 wherein said connecting shaft has a substantially circular external shape and wherein each of said connecting members has an approximate S-shape with a first end thereof connected to said outer peripheral portion and a second end thereof connected to said at least one contact portion such that, when said connecting shaft is rotated, said connecting members are permitted to deform slightly.

14. The sanding apparatus in accordance with claim 11 wherein said brake means further includes an outer peripheral portion mounted at said opening of said housing and wherein said at least one contact portion comprises a plurality of elastic members each having two ends, each of said elastic members being connected to said outer peripheral portion at said two ends so that said elastic members bulge inwardly toward the center of said outer peripheral portion and define an opening which is penetrated by said connecting member.

15. The sanding apparatus in accordance with claim 14 wherein said connecting shaft has a substantially square cross section perpendicular to the axis thereof.

16. The sanding apparatus in accordance with claim 14 wherein said connecting shaft has a circular cross section perpendicular to the axis thereof.

17. The sanding apparatus in accordance with claim 14 wherein said connecting shaft has a circular shape with a plurality of angular protrusions in cross section perpendicular to the axis of said connecting shaft.

18. The sanding apparatus in accordance with claim 16 wherein said connecting shaft includes a plurality of radial protrusions coplanar with a plane perpendicular to the axis of said connecting shaft.

19. The sanding apparatus in accordance with claim 13 wherein said connecting shaft has a non-circular cross-section and said at least one contact portion is shaped to permit said connecting shaft to fit therein.

* * * * *